US008317583B2

(12) United States Patent
Nici

(10) Patent No.: US 8,317,583 B2
(45) Date of Patent: Nov. 27, 2012

(54) CARD GAME

(76) Inventor: Rosario Nici, Monument, CO (US)

( * ) Notice: Subject to any disclaimer, the term of this patent is extended or adjusted under 35 U.S.C. 154(b) by 1149 days.

(21) Appl. No.: 11/764,657

(22) Filed: Jun. 18, 2007

(65) Prior Publication Data

US 2008/0274791 A1 Nov. 6, 2008

Related U.S. Application Data

(63) Continuation-in-part of application No. 11/743,414, filed on May 2, 2007.

(51) Int. Cl.
*G06F 17/00* (2006.01)

(52) U.S. Cl. ..... 463/11; 273/292

(58) Field of Classification Search ..... 463/9–11; 273/292

See application file for complete search history.

(56) References Cited

U.S. PATENT DOCUMENTS 5,720,484 A 2/1998 Hsu
5,865,437 A 2/1999 Moore
6,523,829 B1 * 2/2003 Walker et al. ..... 273/292

OTHER PUBLICATIONS

Merriam-Webster Online Dictionary, <http://www.merriam-webster.com/dictionary/fee>.*

* cited by examiner

*Primary Examiner* — Michael Cuff

(74) *Attorney, Agent, or Firm* — Pannell Law, LLC; Mark G. Pannell

(57) ABSTRACT

A card game is played between a dealer and at least one player. Each player is required to ante a bet before receiving a hand of cards. Cards are dealt to the dealer and each player so that the dealer and each player each receive two cards with at least one of the faces of the dealer's cards hidden from each player. Each player is permitted to view their cards and the make additional bets. The hidden faces of the cards dealt to the dealer are revealed. Each player holding a hand wherein the sum of the player's cards is within a selected amount of the sum of the dealer's cards is identified as a winner.

10 Claims, 3 Drawing Sheets

CARD GAME

CROSS REFERENCE

This application is a Continuation in Part of co-pending U.S. application Ser. No. 11/743,414 filed on May 2, 2007.

BACKGROUND OF THE INVENTION

Betting games are a popular form of card game. There are countless variations of betting games, but many have certain common features. All players bet equal sums of money into a betting pool for that hand called a "pot". This initial bet is called an ante. Each player then receives a number of cards. There is a round of betting, where players bet commensurate with how they feel their hand will fare among the hands of other players and the dealer. Players who feel they have losing hands may instead drop out of the competition, or "fold". Remaining players then often have the opportunity to modify their hands by either replacing cards or adding cards, depending on the game being played. Another round of betting may take place, followed by another period where players may modify their hands. This scenario may repeat one or more times, depending on the game being played, ending in a period where the hands of players remaining in the game are compared to each other or the dealer to determine the winner.

DETAILED DESCRIPTION OF THE INVENTION

Figure 1:
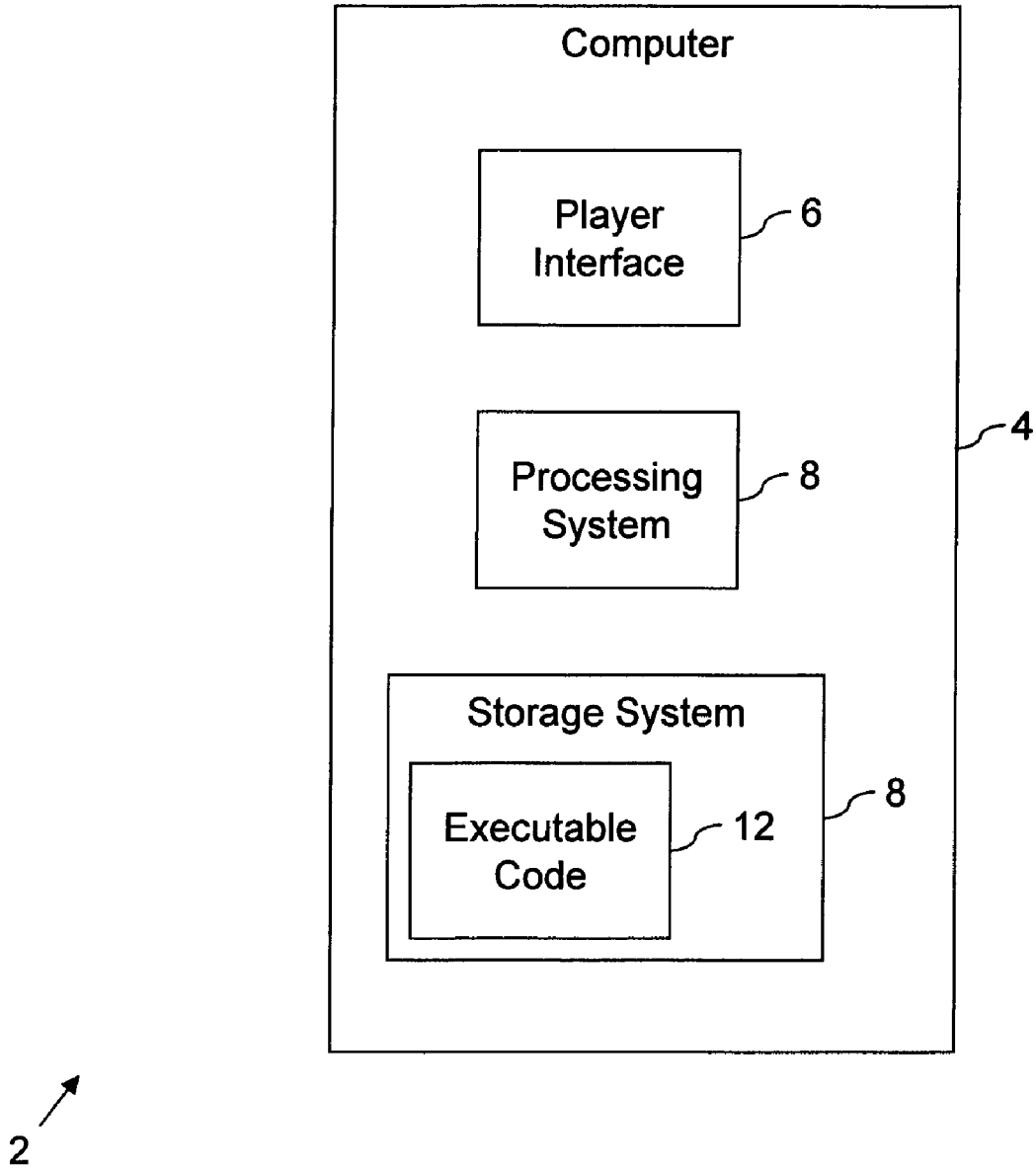
FIG. 1 is block diagram illustrating a system for playing the card game of the present invention.

FIG. 1 shows one embodiment of a system 2 for playing a card game. The card game may be played using standard playing cards or special playing cards, provided each card has a face.

Card game system 2 includes computer 4. In this embodiment, the card game is played on a computer and uses computer simulated cards.

Computer 4 is any specific or general purpose computer usable by an individual to perform the steps of the process of the present invention. In one embodiment, computer 4 includes user interface 6, processing system 8, and storage system 10.

User Interface 6 is any combination of hardware and software for providing feedback to a user and for allowing the user to input into the computer. In one embodiment, user interface 2 includes a display monitor and a keyboard. In another embodiment, user interface 2 includes a touch screen monitor.

Processing system 8 is any combination of hardware and executable code configured to process software for performing the assessment of the present invention process.

Storage system 10 is any device or system configured to store data or executable code 12. Storage system 10 may also be a program storage system tangibly embodying a program, applet, or instructions executable by processing system 8 for performing the method steps of the present invention executable by processing system 8. Storage system 10 may be any type of storage media such as magnetic, optical, or electronic storage media.

Storage system 10 is illustrated in FIG. 1 as a single device. Alternatively, storage system 10 may include more than one device. Furthermore, each device of storage system 10 may be embodied in a different media type. For example, one device of storage system 10 may be a magnetic storage media while another device of storage system 10 is an electronic storage media.

Executable code 12 is any type of executable code which, when executed, performs the method steps of the present invention process. Executable code 12 may be stored in storage system 10 and processed in processing system 8.

Figure 2A:
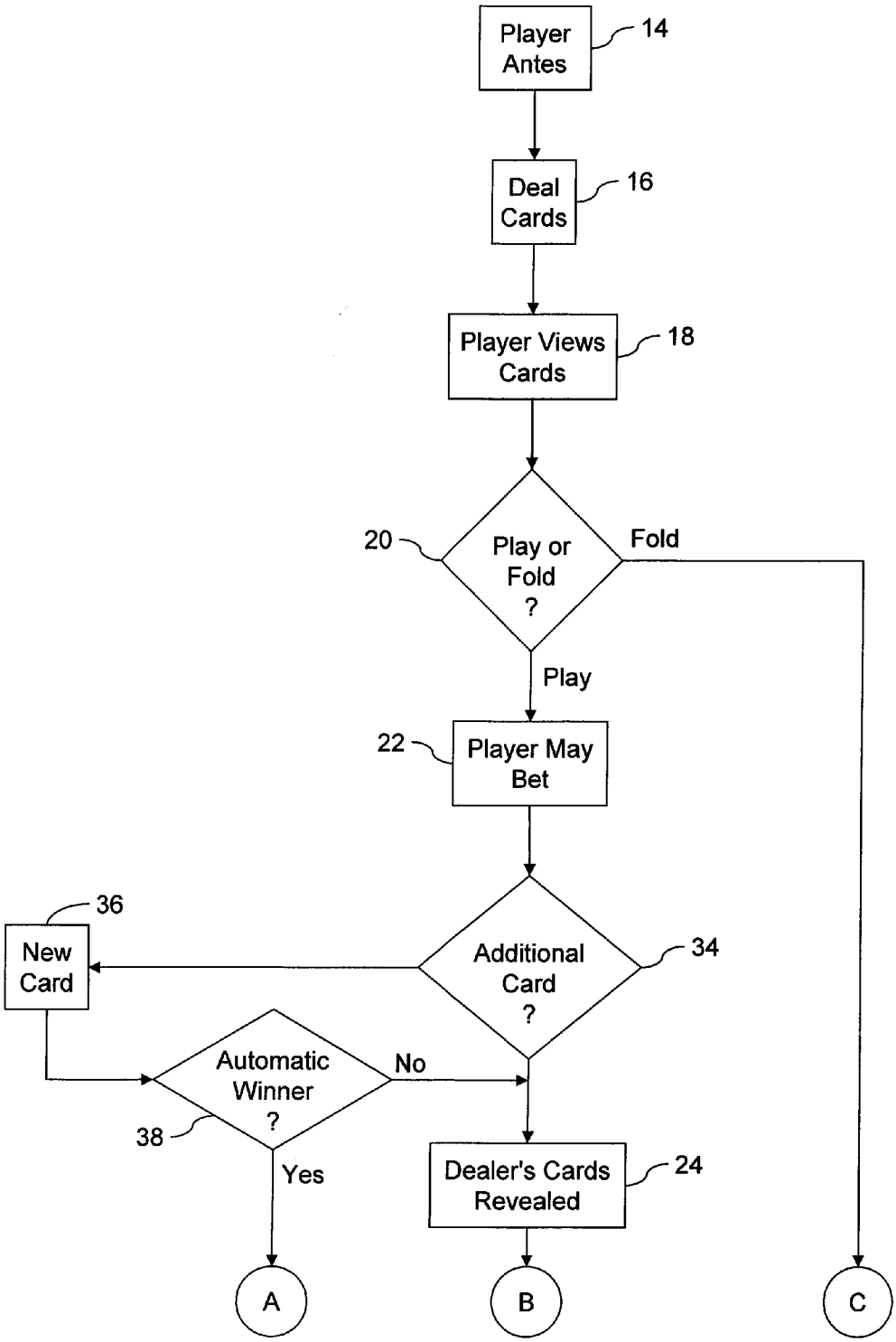
FIGS. 2*a* and 2*b* are a flow chart illustrating one embodiment of the method of the present invention card game.
Figure 2B:
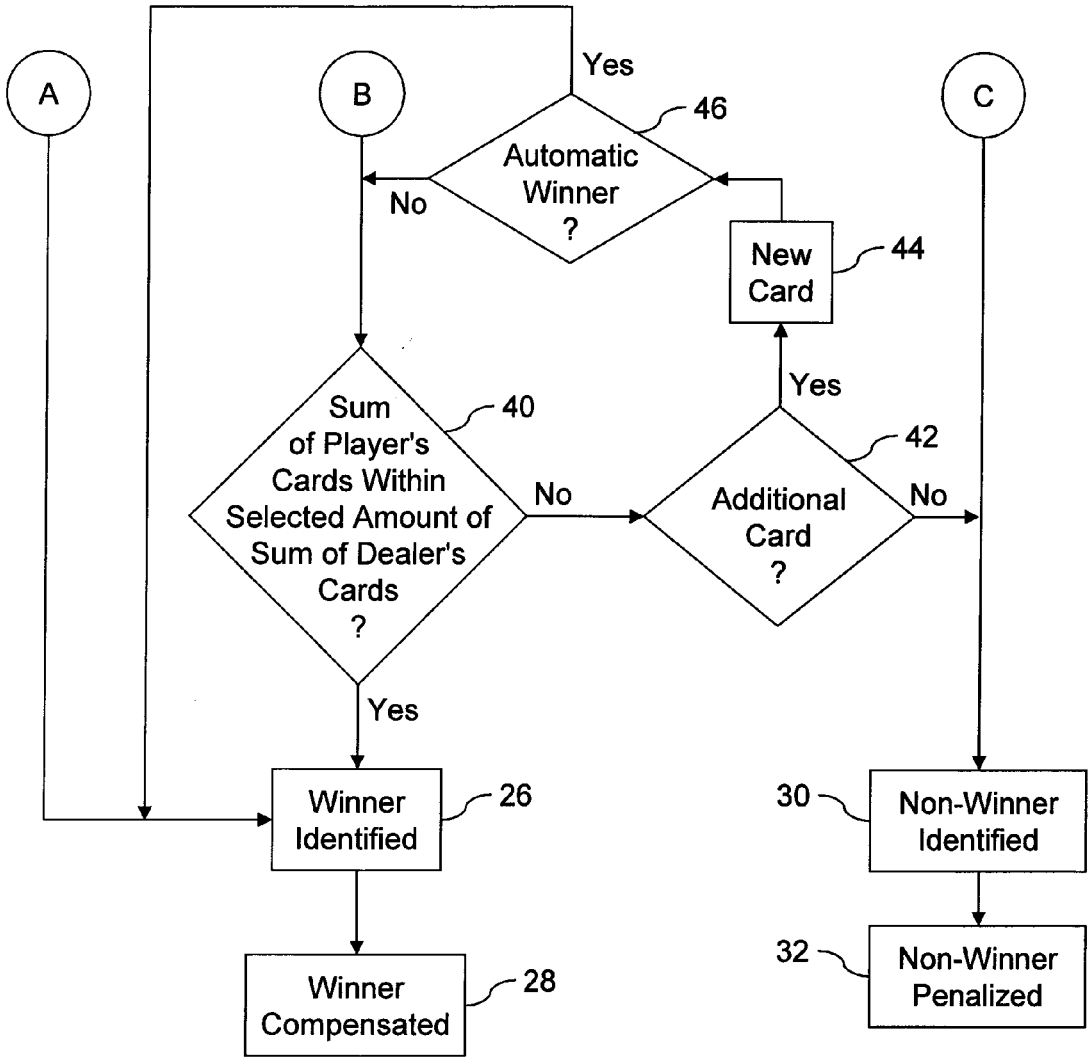

FIGS. 2*a* and 2*b* are a flow chart representing steps of one embodiment of the present invention. Although the steps represented in FIGS. 2*a* and 2*b* are presented in a specific order, the present invention encompasses variations in the order of steps. Furthermore, additional steps may be executed between the steps illustrated in FIGS. 2*a* and 2*b* without departing from the scope of the present invention.

Each player is required to ante 14 a bet before receiving a hand of cards. The bet may be made with anything that represents or simulates something of value. For example, the bet may be made with money, chips, or credits.

Cards are dealt 16 to the dealer and each player. The dealer and each player each receive two cards. At least one of the faces of the dealer's cards is hidden from the players. The players are permitted to view 18 their cards. Each player decides 20 whether to continue play, or to fold.

Each continuing player is permitted to make 22 additional bets. The bets may be made with anything that represents or simulates something of value. For example, the bets may be made with money, chips, or credits.

Each continuing player may be permitted 34 to pay a fee and receive 36 an additional card or replace an existing card. In one embodiment, the additional card is either added to or subtracted from the sum of the player's hand depending on a characteristic of the additional card. For example, a red card may be subtracted from the sum of the player's hand while a black card is added to the sum of the player's hand. In another example, odd valued cards are subtracted from the sum of a player's hand while even valued cards are added to the sum of the player's hand. In one embodiment, the sum of the player's cards can go no lower than zero.

In one embodiment, certain cards in the deck may be indicative of an automatic win for the player receiving the cards. In such embodiment, should 38 a player receive one of the certain automatically winning cards, the player automatically wins regardless of the sum of the player's cards and the sum of the dealer's cards.

Next, the hidden faces of the dealer's cards are revealed 24 to the players. Each player holding a hand wherein the sum of the player's cards is within 40 a selected amount of the sum of the dealer's cards is identified 26 as a winner. Each winner is compensated 28 by awarding money, or the like, to the winner. Often the winner is compensated in the same form as the bet or bets.

Each player holding a hand wherein the sum of the player's cards is outside 40 a selected amount of the sum of the dealer's cards may be permitted 42 to pay a fee and receive 44 an additional card or replace an existing card. In one embodiment, the additional card is either added to or subtracted from the sum of the player's hand depending on a characteristic of the additional card. For example, a red card may be subtracted from the sum of the player's hand while a black card is added to the sum of the player's hand. In another example, odd valued cards are subtracted from the sum of a player's hand while even valued cards are added to the sum of the player's hand. In one embodiment, the sum of the player's cards can go no lower than zero.

In one embodiment, certain cards in the deck may be indicative of an automatic win for the player receiving the cards. In such embodiment, should 46 a player receive one of the certain automatically winning cards, the player automatically wins regardless of the sum of the player's cards and the sum of the dealer's cards.

In one embodiment, the additional card is either added to or subtracted from the sum of the dealer's cards depending on a characteristic of the additional card. For example, a red card may be subtracted from the sum of the dealer's hand while a black card is added to the sum of the dealer's hand. In another example, odd valued cards are subtracted from the sum of a dealer's hand while even valued cards are added to the sum of the dealer's hand. In one embodiment, the sum of the dealer's cards can go no lower than zero.

Where the additional card is either added to or subtracted from the dealer's cards, it may be desirable to allow the addition or subtraction to affect only the player purchasing the additional card.

Each player holding a hand wherein the sum of the player's cards is outside 40 a selected amount of the sum of the dealer's cards that is either not permitted 42 to pay a fee to receive an additional card or elects not to pay the fee is identified 30 as a non-winner. In one embodiment, each player declining to make additional bets is also identified 30 as a non-winner. Each non-winner is penalized 32 by causing each non-winner to lose the totality of each non-winner's ante and additional bets.

In one embodiment, the sum of each player's hand is the sum of the face value of each card from two through ten, ten for each face card, and at the discretion of the player, either one or eleven for each ace. The sum of the dealer's hand is the sum of the face value of each card from two through ten, ten for each face card, one if the first card received by the dealer is an ace, and eleven if the second card received by the dealer is an ace.

In an alternate embodiment, the sum of each player's hand is the sum of the face value of each card from two through ten, eleven for each jack, twelve for each queen, thirteen for each king, and at the discretion of the player, either one or fourteen for each ace. The sum of the dealer's hand is the sum of the face value of each card from two through ten, eleven for each jack, twelve for each queen, thirteen for each king, one if the first card received by the dealer is an ace, and fourteen if the second card received by the dealer is an ace. A variation of this embodiment allows an ace to have a value of one or eleven instead of one or fourteen. In other variations of this embodiment, the value of the ace is selected between one and any other agreed upon value.

In one embodiment, random events may occur which affect the player's cards, the dealer's cards, or the player's cards and the dealer's cards. For example, the one or more cards from wither the player or the dealer may be replaced with a new card. In another example, the cards may be revalued using different valuation system. These random events are particularly well suited for embodiments of the card game played on computer 4.

The foregoing description is only illustrative of the invention. Various alternatives, modifications, and variances can be devised by those skilled in the art without departing from the invention. Accordingly, the present invention embraces all such alternatives, modifications, and variances that fall within the scope of the described invention.

What is claimed is:

1. A program storage system readable by a computer, tangibly embodying a program, applet, or instructions executable by the computer to perform a method for playing a card game between a dealer and at least one player, the method comprising:

requiring each player to ante a bet before receiving a hand of cards;

dealing cards to the dealer and each player so that the dealer and each player each receive two cards with at least one of the faces of the dealer's cards hidden from each player;

permitting each player to view their cards;

permitting each player to make additional bets;

revealing the hidden faces of the cards dealt to the dealer;

identifying as a winner each player conditioned upon the sum of the player's cards being within a selected amount of the sum of the dealer's cards and less than the sum of the dealer's cards;

identifying as a winner each player conditioned upon the sum of the player's cards being within a selected amount of the sum of the dealer's cards and greater than the sum of the dealer's cards;

identifying as a winner each player conditioned upon the sum of the player's cards being equal to the sum of the dealer's cards; and wherein the selected amount is at least one.

2. The program storage system of claim 1 wherein the method further includes identifying as a non-winner each player holding a hand wherein the sum of the player's cards is outside the selected amount of the sum of the dealer's cards.

3. The program storage system of claim 1 wherein the method further includes permitting each player to pay a fee to receive an additional card.

4. The program storage system of claim 3 wherein the additional card is either added to or subtracted from the sum of the player's cards depending on a characteristic of the additional card.

5. The program storage system of claim 1 wherein the method further includes permitting each player to pay a fee for the dealer to receive an additional card.

6. The program storage system of claim 5 wherein the additional card is either added to or subtracted from the sum of the dealer's cards depending on a characteristic of the additional card.

7. The program storage system of claim 1 wherein the sum of each player's hand includes the sum of:

the face value of each card from two through ten;

ten for each face card; and at the discretion of the player, either one or eleven for each ace.

8. The program storage system of claim 1 wherein the sum of each player's hand includes the sum of:

the face value of each card from two through ten;

eleven for each jack;

twelve for each queen;

thirteen for each king; and at the discretion of the player, either one or fourteen for each ace.

9. The program storage system of claim 1 wherein the sum of the dealer's hand includes the sum of:

the face value of each card from two through ten, ten for each face card, one if the first card received by the dealer is an ace, and eleven if the second card received by the dealer is an ace.

10. The program storage system of claim 1 wherein the sum of the dealer's hand includes the sum of:

the face value of each card from two through ten, eleven for each jack, twelve for each queen, thirteen for each king, one if the first card received by the dealer is an ace, and fourteen if the second card received by the dealer is an ace.

* * * * *